US009524601B1

(12) United States Patent
Dumas

(10) Patent No.: US 9,524,601 B1
(45) Date of Patent: Dec. 20, 2016

(54) WIRELESS ACCESS CONTROL SYSTEM INCLUDING DOOR POSITION BASED LOCK SWITCHING AND RELATED METHODS

(71) Applicant: Unikey Technologies Inc., Orlando, FL (US)

(72) Inventor: Philip C. Dumas, Orlando, FL (US)

(73) Assignee: UNIKEY TECHNOLOGIES INC., Orlando, FL (US)

( * ) Notice: Subject to any disclaimer, the term of this patent is extended or adjusted under 35 U.S.C. 154(b) by 0 days.

(21) Appl. No.: 14/981,093

(22) Filed: Dec. 28, 2015

(51) Int. Cl.
*G07C 9/00* (2006.01)

(52) U.S. Cl.
CPC . *G07C 9/00309* (2013.01); *G07C 2009/00769* (2013.01)

(58) Field of Classification Search
CPC ..... G07C 9/00309; G07C 2009/00769; G07C 9/00007; G07C 9/00111; G07C 9/00571; G07C 2009/00793; G07C 2209/63
USPC ..... 340/5.61
See application file for complete search history.

(56) References Cited

U.S. PATENT DOCUMENTS 5,820,177 A 10/1998 Moon
5,987,818 A 11/1999 Dabideen
6,615,629 B2 9/2003 Bates et al.
6,720,861 B1 * 4/2004 Rodenbeck ..... G07C 9/00103 340/5.6
7,012,503 B2 * 3/2006 Nielsen ..... G07C 9/00103 340/5.6
7,262,518 B2 8/2007 Nagano et al.
7,336,151 B2 2/2008 Ueda et al.
7,388,467 B2 6/2008 Fisher et al.
7,456,725 B2 * 11/2008 Denison ..... B60R 25/102 340/10.33
7,515,033 B2 4/2009 Roosli et al.
7,548,151 B2 6/2009 Roosli et al.
7,999,656 B2 8/2011 Fisher
8,054,158 B2 11/2011 Nakashima
8,531,269 B2 9/2013 Nagao et al.
8,717,142 B2 5/2014 Nagao et al.
8,937,526 B2 1/2015 Chandler, Jr.
(Continued)

FOREIGN PATENT DOCUMENTS

CN 203795974 U 8/2014
KR 20030083538 A 10/2003
WO 2013024202 A1 2/2013

*Primary Examiner* — Mark Blouin
(74) *Attorney, Agent, or Firm* — Allen, Dyer, Doppelt, Milbrath & Gilchrist, P.A.

(57) ABSTRACT

A wireless access control system may include a remote access wireless communications device and a lock assembly. The lock assembly may include a lock switchable between locked and unlocked positions, a door position sensor, interior and exterior directional antennas, lock wireless communications circuitry coupled to the interior and exterior directional antennas, a touch sensor, and a lock controller. The lock controller may unlock the lock based upon the touch sensor, determine when the door is closed after being opened based upon the door position sensor, and determine whether the remote access wireless device is in an interior or an exterior area based upon directional antennas. The lock controller may also switch the lock to the locked position when the door is closed and when the remote access wireless device is in the interior area, and not switch the lock to the locked position when the door is open.

24 Claims, 3 Drawing Sheets

(56) References Cited

U.S. PATENT DOCUMENTS

| | | | | |
|---|---|---|---|---|
| 2003/0214384 | A1 | 11/2003 | Milo | |
| 2006/0164208 | A1 | 7/2006 | Schaffzin et al. | |
| 2008/0174403 | A1 | 7/2008 | Wolpert et al. | |
| 2012/0280790 | A1 | 11/2012 | Gerhardt et al. | |
| 2013/0237193 | A1 | 9/2013 | Dumas et al. | |
| 2014/0022054 | A1 | 1/2014 | Bliding et al. | |
| 2014/0049361 | A1 | 2/2014 | Ahearn et al. | |
| 2014/0049367 | A1 | 2/2014 | Ahearn et al. | |
| 2014/0049369 | A1 | 2/2014 | Ahearn et al. | |
| 2014/0292481 | A1* | 10/2014 | Dumas | G07C 9/00111 340/5.61 |
| 2014/0340196 | A1 | 11/2014 | Myers et al. | |
| 2015/0061830 | A1 | 3/2015 | Yamane et al. | |
| 2015/0070136 | A1 | 3/2015 | Kameyama et al. | |
| 2015/0116082 | A1 | 4/2015 | Cregg et al. | |
| 2015/0211259 | A1 | 7/2015 | Dumas et al. | |
| 2015/0213658 | A1 | 7/2015 | Dumas et al. | |
| 2015/0213663 | A1* | 7/2015 | Dumas | G07C 9/00571 340/5.31 |
| 2016/0086400 | A1* | 3/2016 | Dumas | G07C 9/00007 340/5.61 |

* cited by examiner

WIRELESS ACCESS CONTROL SYSTEM INCLUDING DOOR POSITION BASED LOCK SWITCHING AND RELATED METHODS

TECHNICAL FIELD

The present disclosure is directed to the field of electronics, and more particularly, to wireless access control and related methods.

BACKGROUND

Protecting or securing access to an area may be particularly desirable. For example, it is often desirable to secure a home or business. One way of securing access to an area is with a mechanical lock. A mechanical lock typically accepts a key, which may move a deadbolt or enable a door handle to be operated.

It may be desirable to increase user convenience with respect to a mechanical lock. A passive keyless entry (PKE) system may provide an increased level of convenience over a standard lock and key, for example, by providing the ability to access a secure area without having to find, insert, and turn a traditional key. For example, a user may access a secure area using a remote access device, such as, for example, a FOB or mobile wireless communications device. In a PKE system, access may be provided to the secure area without pressing a button or providing other input to the remote device, thus making it passive.

U.S. Patent Application Publication No. 2014/0340196 to Myers et al. discloses an access control system via direct and indirect communications. More particularly, Myers et al. discloses a lock assembly communicating with a mobile device and a gateway to communicate with the lock. Operating commands such as lock and unlock are communicated directly from the mobile device or indirectly after confirming, for example, using GPS coordinates of the mobile device.

U.S. Patent Application Publication No. 2012/0280790 to Gerhardt et al. is directed to a system for controlling a locking mechanism using a portable electronic device. More particularly, Gerhardt et al. discloses using a web service to authenticate a portable electronic device, detecting the proximity of the portable electronic device to the lock, and issuing a command for receipt by the lock from the web service or portable electronic device.

U.S. Patent Application No. 2006/0164208 to Schaffzin et al. is directed to a universal hands free key and lock system. A universal key that transmits an ID to a lock unit. The lock unit has a range limited reader. The lock unit detects the transmitted ID and based thereon operates the lock.

SUMMARY

A wireless access control system may include a remote access wireless communications device and a lock assembly to be mounted on a door remotely from the remote access wireless communications device. The lock assembly may include a lock switchable between locked and unlocked positions, a door position sensor, interior and exterior directional antennas, lock wireless communications circuitry coupled to the interior and exterior directional antennas, a touch sensor, and a lock controller coupled to the lock, the door position sensor, the lock wireless communications circuitry, and the touch sensor. The lock controller may be configured to unlock the lock based upon the touch sensor to permit a user to open the door, determine when the door is closed after being opened based upon the door position sensor, and determine whether the remote access wireless device is in an interior area or an exterior area based upon the interior and exterior directional antennas. The lock controller may also be configured to switch the lock to the locked position when the door is closed and when the remote access wireless device is determined to be in the interior area, and not switch the lock to the locked position when the door is open. Accordingly, the lock controller may not lock the lock when the remote access wireless device is in the exterior area and lock the lock when the remote access wireless device is in the interior areas, for example, which may provide additional user conveniences while maintaining security.

The lock controller may be configured to switch the lock to the unlocked position when the door is open. The lock controller may be configured to switch the lock to the unlocked position when the door is within 10-degrees of being closed, for example. The lock controller may be configured to switch the lock to the unlocked position after the lock is manually switched to the locked position while the door is open, for example.

The lock controller may be configured not switch the lock to the lock position by at least disabling the touch sensor when the door is open. The lock controller may be configured to not switch the lock to the lock position by at least disabling commands received from the remote access wireless communications device when the door is open, for example. The lock controller may be configured to switch the lock to the locked position after a threshold time period of the door being closed.

The touch sensor may include a physical-touch sensor configured to sense physical contact with the user, for example. The touch sensor may include a proximity-based touch sensor configured to sense a proximity of the user thereto.

The door position sensor may include an accelerometer. The door position sensor may include a magnetometer, for example.

A method aspect is directed to a method of controlling access in a wireless access control system that includes a remote access wireless communications device and a lock assembly to be mounted on a door remotely from the remote access wireless communications device. The lock assembly includes a lock switchable between locked and unlocked positions, a door position sensor, interior and exterior directional antennas, lock wireless communications circuitry coupled to the interior and exterior directional antennas, a touch sensor, and a lock controller coupled to the lock, the door position sensor, the lock wireless communications circuitry, and the touch sensor. The method includes using the lock controller to unlock the lock based upon the touch sensor to permit a user to open the door, determine when the door is closed after being opened based upon the door position sensor, and determine whether the remote access wireless communications device is in an interior area or an exterior area based upon the interior and exterior directional antennas. The method also includes using the lock controller to switch the lock to the locked position when the door is closed and when the remote access wireless communications device is determined to be in the interior area, and not switch the lock to the locked position when the door is open.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
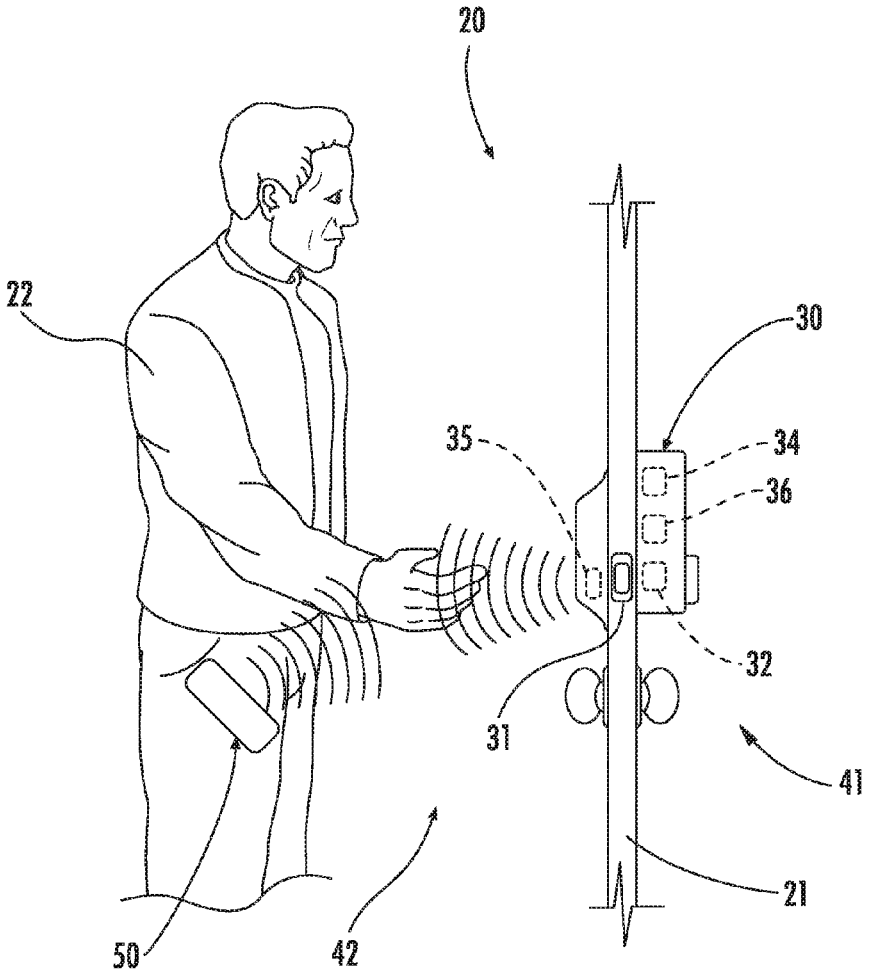
FIG. 1 is a diagram illustrating a side schematic view of a lock assembly of a wireless access control system and a remote access device of the wireless access control system carried by a user in accordance with an embodiment.
Figure 2:
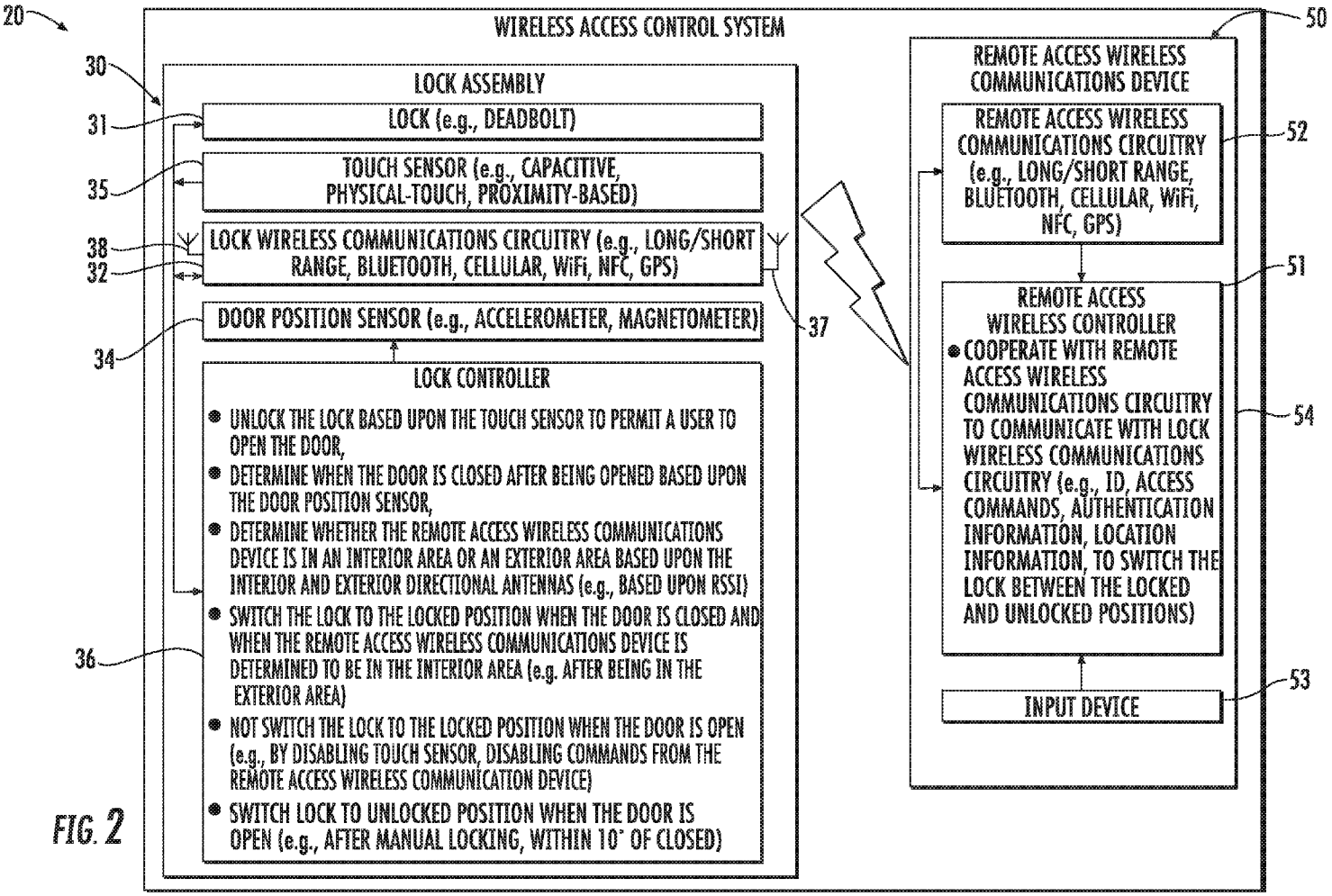
FIG. 2 is a schematic block diagram of the wireless access control system of FIG. 1.

Referring initially to FIGS. 1 and 2, a wireless access control system 20 for a door 21 may include a lock assembly 30 carried by the door. The door 21 may be an interior door, exterior door, overhead garage door, a door to a structure, overhead door, sliding door, screen door, revolving door, for example, a home or business, or any other door that separates an area where protection of that area may be desirable.

The lock assembly 30 may be considered a smart lock and illustratively includes a lock 31 switchable between a locked position and an unlocked position, lock wireless communications circuitry 32, and a door position sensor 34. The lock 31 may be cylinder lock, a deadbolt, or other type of lock, as will be appreciated by those skilled in the art. In some embodiments, the lock 31 may accept a physical key, for example, for manual or key operation of the lock. The lock assembly 30 is illustratively exposed on both the interior and exterior of the door 21. It should be understood that the term interior may refer to the side of the door 21 that faces an area desirable of protection or secured space. For example, where the lock assembly 30 is carried by a door of a home, the interior side 41 is the side within the home, while the exterior side 42 is outside the home and may be accessible to people other than the home's inhabitants.

The lock wireless communications circuitry 32 may be configured to communicate via one or more short range wireless communications protocols, for example, Bluetooth, NFC, WLAN, or other communications protocols. The lock wireless communications circuitry 32 may also communicate via a long range communication protocol, for example, cellular, or global positioning system, or other long range communication protocol. The lock wireless communications circuitry 32 may communicate using either or both of one or more short and long range protocols, as will be appreciated by those skilled in the art.

The lock assembly 30 also includes interior and exterior directional antennas 37, 38 coupled to the lock wireless communications circuitry 32. The interior and exterior directional antennas are pointed or directed to interior and exterior areas 41, 42 respectively.

The lock assembly 30 also illustratively includes a door position sensor 34. The door position sensor 34 may include an accelerometer, for example. The door position sensor 34 may also include a magnetometer. In some embodiments, the door position sensor 34 may include both an accelerometer and a magnetometer, or other and/or additional devices, sensors, or circuitry configured to sense a position of the door 21. For example, the door position sensor 34 may determine when the door 21 has been opened and/or closed, moved, stationary, etc. A pattern of movement of the door 21 can be determined, for example, opened and then closed, closed then opened, based upon the door position sensor 34.

The lock assembly 30 also illustratively includes a touch sensor 35 on the exterior of the lock assembly 30 to sense touching by a user 22. The touch sensor 35 may be a capacitive touch sensor, for example, and when the lock 31 includes a key hole, may be positioned around the key hole. The touch sensor 35 may be positioned elsewhere on the lock assembly 30. More than one touch sensor 35 may be used. For example, in some embodiments, the lock assembly 30 may include an interior touch sensor and an exterior touch sensor. Other types of touch sensors may also be used. For example, the touch sensor 35 may not necessarily sense touching directly from a user, but rather touching using an intervening object that may be an extension of the user. The lock 31 may be switched between the locked and unlocked positions based upon the touch sensor 35. For example, the user 22 may lock the door 21 by touching the touch sensor 35.

The touch sensor 35 may be a physical-touch sensor for sensing physical contact with the user, for example. The touch sensor 35 may alternatively or additionally be a proximity-based touch sensor configured to sense proximity of the user thereto. In other words, while a touch sensor 35 is described herein, the touch sensor senses either a physical touch of the user or when the user is in a relatively close proximity to the touch sensor, for example, a small distance from the lock assembly 30 (e.g., less than 12 inches), such as by an access card reader, a FOB reader, or other circuitry to sense a user within a relatively small distance from the lock assembly 30 or door 21.

The wireless access control system 20 also illustratively includes a remote access device 50 remote from the lock assembly 30. The remote access device 50 includes a remote access device controller 51 and remote access wireless communications circuitry 52 coupled to the remote access device controller 51. The remote access device controller 51 and the remote access device wireless communications circuitry 52 cooperate to communicate with the lock wireless communications circuitry 32. For example, the remote access device controller 51 and the remote access device wireless communications circuitry 52 cooperate to communicate access commands, location information, authentication information, and/or other information for communicating with and controlling operation of the lock 31, and/or other devices that may be included in the wireless access control system 20, as will be appreciated by those skilled in the art. The remote access device controller 51 may also communicate with the lock wireless communications circuitry 32 for switching said lock between the locked and unlocked positions. Similar to the lock wireless communication circuitry 32, the remote access device wireless communications circuitry 52 may communicate using one or both of short range and long range communications protocols.

The remote access device 50 may be in the form of a fob or keychain, and may include housing 54 carrying a battery for powering the remote access device controller 51 and wireless communications circuitry 52, and at least one input device 53 carried by the housing and coupled to the remote access device controller 51. In other embodiments, the remote access device 50 may be a cellular telephone, tablet PC, or any other portable wireless communications device. The lock assembly 30 further includes a lock controller 36 coupled to lock 31, the lock wireless communications circuitry 32, the door position sensor 34, and the touch sensor 35.

Figure 3:
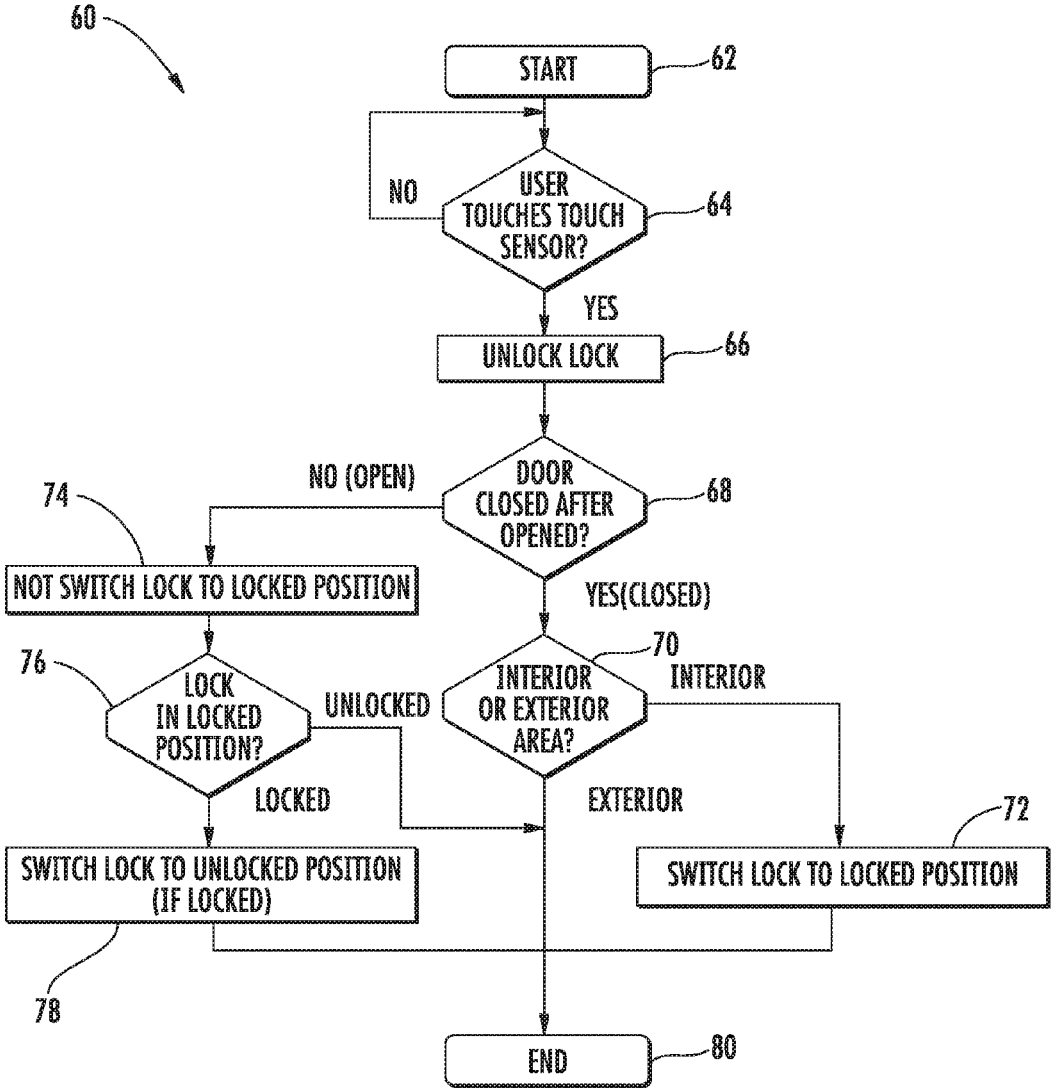
FIG. 3 is a flowchart illustrating operation of the wireless access control system of FIG. 1.

Referring now additionally to the flowchart 60 in FIG. 3, beginning at Block 62, operation of the wireless access control system 20 will also be described. The lock controller 36 is configured to unlock the lock 31 based upon the touch sensor 35 to permit a user 22 to open the door 21. More particularly, the lock controller 36 may switch the lock 31 to the unlocked position (Block 66) based upon the user 22 touching the touch sensor 35 (Block 64).

As will be appreciated by those skilled in the art, during a typical touch-to-unlock operation based upon the touch sensor 35, the lock controller 36 may "wake-up" from a low power mode and begin scanning for an advertising remote access wireless communications device 50. The lock controller 36 may, thereafter, connect with an in-range remote access wireless communications device 50 and determine the identity of the in-range remote access wireless communications device. If the remote access wireless communications device 50 is authorized to access the lock, the lock controller 36 may cooperate with the lock wireless communications circuitry 32 and based upon the interior and exterior directional antennas 37, 38 determine whether the remote access wireless communications device is in the interior area 41 or the exterior area 42. If the user 22 is authorized to access the lock, e.g. at that time, and the remote access wireless communications device is determined to be in the exterior area 42, the lock controller 36 may switch the lock before returning to the low-power mode. It should be noted that it generally takes about 1 to 2 seconds from the time the user 22 touches the touch sensor 35 until the lock is switched.

At Block 68, the lock controller 36 determines when the door is closed after being opened based upon the door position sensor 34. In some embodiments, the lock controller 36 may "wake-up" from a low power mode and begin scanning for an advertising remote access wireless communications device 50 based upon the door position sensor 34 or motion of the door 21. The lock controller 36, at Block 70, also determines whether the remote access wireless communications device 50 is in the interior area 41 or the exterior area 42 based upon the interior and exterior directional antennas 37, 38. The lock controller 36 may determine whether the remote access wireless communications device 50 is in the interior area 41 or exterior area 42 based upon a received signal strength indicator (RSSI) from the interior and exterior directional antennas 37, 38 (e.g. to determine location of or direction of movement of the remote access wireless communications device 50). Of course, the lock controller 36 may determine whether the remote access wireless communications device 50 is within the interior area 41 or exterior area 42 based upon other and/or additional techniques.

When the door is closed (Block 68) and when the remote access wireless communications device is determined to be in the interior area (Block 70), the lock controller 36 switches the lock 31 to the locked position (Block 72). The lock controller 36 may switch the lock 31 to the locked position based upon the expiration of a threshold time period from the close of the door 21.

When the door 21 is open (Block 68), for example, after a threshold time period, the lock controller 36 does not switch the lock 31 to the locked position (Block 74). More particularly, the lock controller 36 may not switch the lock 31 to the locked position by disabling the touch sensor 35 and/or disabling commands received from the remote access wireless communications device 50.

If, the lock 31 is in the locked position (Block 76) and the door 21 is open (Block 68), or more particularly within 10-degrees of closed, the lock controller 36 may switch the lock to the unlocked position (Block 78). The lock 31 may become locked while the door 21 is open, for example, by the user 22 manually switching the lock to the locked position while the door is open. The lock controller 36 may begin switching the lock 31 to the unlocked position at different door-open positions (i.e., within x-degrees of closed), for example, based upon a speed of movement of the door 21. A speed-of-door to door position table may be stored in a memory coupled to the lock controller 36 and used to determine when to initiate the unlocking of the lock 31.

In some embodiments, if the user 22 attempts to operate the lock 31, either via the remote access wireless communications device 50 or via a thumb-turn, for example, the user may receive a notification that the lock cannot be switched because the door 21 is open. The notification may be audible, visual, tactile, or a combination thereof, and may be generated by the remote access wireless communications device 50 and/or the lock assembly through displays, visual indicators, etc., as will be appreciated by those skilled in the art. The method ends at Block 80.

As will be appreciated by those skilled in the art, the wireless access control system 20 may be particularly advantageous in reducing the occurrences of the lock "locking itself" while the door 21 is still open. For example, when a user 22 opens the door 21 and walks through the doorway, the user may accidentally (and sometimes unknowingly) brush up against or come in relatively close proximity to the touch sensor 35 with their arm, elbow, or hand, for example. Upon doing so, the lock controller may execute a "touch event" for example, causing the lock to be switched to the locked position while the door 21 is still open.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A wireless access control system comprising:

a remote access wireless communications device; and a lock assembly to be mounted on a door remotely from said remote access wireless communications device, said lock assembly comprising a lock switchable between locked and unlocked positions, a door position sensor, interior and exterior directional antennas, lock wireless communications circuitry coupled to said interior and exterior directional antennas, a touch sensor, and a lock controller coupled to said lock, said door position sensor, said lock wireless communications circuitry, and said touch sensor;

said lock controller configured to unlock the lock based upon said touch sensor to permit a user to open the door, determine when the door is closed after being opened based upon said door position sensor, determine whether said remote access wireless communications device is in an interior area or an exterior area based upon said interior and exterior directional antennas, switch said lock to the locked position when the door is closed and when said remote access wireless communications device is determined to be in the interior area, and not switch said lock to the locked position when the door is open.

2. The wireless access control system of claim 1 wherein said lock controller is configured to switch said lock to the unlocked position when the door is open.

3. The wireless access control system of claim 2 wherein said lock controller is configured to switch said lock to the unlocked position when the door is within 10-degrees of being closed.

4. The wireless access control system of claim 2 wherein said lock controller is configured to switch said lock to the unlocked position after said lock is manually switched to the locked position while the door is open.

5. The wireless access control system of claim 1 wherein said lock controller is configured to not switch said lock to the locked position by at least disabling said touch sensor when the door is open.

6. The wireless access control system of claim 1 wherein said lock controller is configured to not switch said lock to the lock position by at least disabling commands received from said remote access wireless communications device when the door is open.

7. The wireless access control system of claim 1 wherein said lock controller is configured to switch said lock to the locked position after a threshold time period of the door being closed.

8. The wireless access control system of claim 1 wherein said touch sensor comprises a physical-touch sensor configured to sense physical contact with the user.

9. The wireless access control system of claim 1 wherein said touch sensor comprises a proximity-based touch sensor configured to sense a proximity of the user thereto.

10. The wireless access control system of claim 1 wherein said door position sensor comprises an accelerometer.

11. The wireless access control system of claim 1 wherein said door position sensor comprises a magnetometer.

12. The wireless access control system of claim 1 wherein said remote access wireless communications device comprises remote access wireless communications circuitry and a remote access controller coupled thereto; and wherein said remote access controller is configured to communicate via said remote access wireless communications circuitry with said lock wireless communications circuitry for switching said lock between the locked and unlocked positions.

13. A lock assembly for a wireless access control system comprising a remote access wireless communications device, and a lock assembly to be mounted on a door remotely from the remote access wireless communications device, the lock assembly comprising:

a lock switchable between locked and unlocked positions;

a door position sensor;

interior and exterior directional antennas;

lock wireless communications circuitry coupled to said interior and exterior directional antennas;

a touch sensor; and a lock controller coupled to said lock, said door position sensor, said lock wireless communications circuitry, and said touch sensor;

said lock controller configured to unlock the lock based upon said touch sensor to permit a user to open the door, determine when the door is closed after being opened based upon said door position sensor, determine whether the remote access wireless communications device is in an interior area or an exterior area based upon said interior and exterior directional antennas, switch said lock to the locked position when the door is closed and when the remote access wireless communications device is determined to be in the interior area, and not switch said lock to the locked position when the door is open.

14. The lock assembly of claim 13 wherein said lock controller is configured to switch said lock to the unlocked position when the door is open.

15. The lock assembly of claim 14 wherein said lock controller is configured to switch said lock to the unlocked position when the door is within 10-degrees of being closed.

16. The lock assembly of claim 14 wherein said lock controller is configured to switch said lock to the unlocked position after said lock is manually switched to the locked position while the door is open.

17. The lock assembly of claim 13 wherein said lock controller is configured to not switch said lock to the locked position by at least disabling said touch sensor when the door is open.

18. The lock assembly of claim 13 wherein said lock controller is configured to not switch said lock to the lock position by at least disabling commands received from said remote access wireless communications device when the door is open.

19. A method of controller access in a wireless access control system comprising a remote access wireless communications device and a lock assembly to be mounted on a door remotely from the remote access wireless communications device, the lock assembly comprising a lock switchable between locked and unlocked positions, a door position sensor, interior and exterior directional antennas, lock wireless communications circuitry coupled to the interior and exterior directional antennas, a touch sensor, and a lock controller coupled to the lock, the door position sensor, the lock wireless communications circuitry, and the touch sensor, the method comprising:

using the lock controller to unlock the lock based upon the touch sensor to permit a user to open the door, determine when the door is closed after being opened based upon the door position sensor, determine whether the remote access wireless communications device is in an interior area or an exterior area based upon the interior and exterior directional antennas, switch the lock to the locked position when the door is closed and when the remote access wireless communications device is determined to be in the interior area, and not switch the lock to the locked position when the door is open.

20. The method of claim 19 wherein the lock controller is used to switch the lock to the unlocked position when the door is open.

21. The method of claim 20 wherein the lock controller is used to switch the lock to the unlocked position when the door is within 10-degrees of being closed.

22. The method of claim 20 wherein the lock controller is used to switch the lock to the unlocked position after the lock is manually switched to the locked position while the door is open.

23. The method of claim 19 wherein the lock controller is used to not switch the lock to the locked position by at least disabling the touch sensor when the door is open.

24. The method of claim 19 wherein the lock controller is used to not switch the lock to the lock position by at least disabling commands received from the remote access wireless communications device when the door is open.

* * * * *